US007324099B2

(12) United States Patent
Akimoto et al.

(10) Patent No.: US 7,324,099 B2
(45) Date of Patent: Jan. 29, 2008

(54) IMAGE DISPLAY DEVICE

(75) Inventors: Hajime Akimoto, Ome (JP); Toshihiro Satou, Mobara (JP); Hiroshi Kageyama, Hachioji (JP)

(73) Assignee: Hitachi Displays, Ltd., Chiba-ken (JP)

( * ) Notice: Subject to any disclaimer, the term of this patent is extended or adjusted under 35 U.S.C. 154(b) by 482 days.

(21) Appl. No.: 10/772,454

(22) Filed: Feb. 6, 2004

(65) Prior Publication Data

US 2005/0024302 A1 Feb. 3, 2005

(30) Foreign Application Priority Data

Jul. 30, 2003 (JP) ..... P2003-203579

(51) Int. Cl.
*G09G 3/36* (2006.01)

(52) U.S. Cl. ..... 345/205; 345/36; 345/39; 345/45; 345/46

(58) Field of Classification Search ..... 345/36, 345/39, 45, 46, 55, 76, 82, 204, 205
See application file for complete search history.

(56) References Cited

U.S. PATENT DOCUMENTS 6,577,302 B2 * 6/2003 Hunter et al. ..... 345/204
2001/0026251 A1 * 10/2001 Hunter et al. ..... 345/55
2003/0174111 A1 * 9/2003 Ito ..... 345/89
2003/0197666 A1 * 10/2003 Akimoto et al. ..... 345/82
2004/0016924 A1 * 1/2004 Yamada et al. ..... 257/59
2004/0239586 A1 * 12/2004 Cok ..... 345/55
2005/0123265 A1 * 6/2005 Kimura ..... 385/147
2005/0145891 A1 * 7/2005 Abe ..... 257/288
2005/0219163 A1 * 10/2005 Smith et al. ..... 345/76

OTHER PUBLICATIONS

R.M.A. Dawson et al., "The Impact of the Transient Response of Organic Light Emitting Diodes on the Design of Active Matrix OLED Displays", IEEE 1998, IEDM 98, pp. 875-878.

Tatsuya Sasaoka et al., "24.4L: Late-News Paper: A 13.0-inch AM-OLED Display with Top emitting Structure and Adaptive Current Mode Programmed Pixel Circuit (TAC)", SID—1 DIGEST (2001), pp. 384-387.

* cited by examiner

*Primary Examiner*—Bipin Shalwala
*Assistant Examiner*—Vincent E. Kovalick
(74) *Attorney, Agent, or Firm*—Reed Smith LLP; Stanley P. Fisher, Esq.; Juan Carlos A. Marquez, Esq.

(57) ABSTRACT

In an image display device according to the present invention, means for selecting a pixel to which a display signal current is to be passed has a function of selecting a plurality of pixels simultaneously. Thus, high-precision display can be realized with a number of pixels.

13 Claims, 7 Drawing Sheets

IMAGE DISPLAY DEVICE

BACKGROUND OF THE INVENTION

1. Field of the Invention

The present invention relates to an image display device easily realizing a larger number of pixels and, more particularly, to an image display device suitable for achieving higher precision.

2. Description of the Prior Art

Two prior arts will be described hereinbelow with reference to FIGS. 9 to 12.

FIG. 9 is a diagram showing a general configuration of a light emitting display device as a first prior art. In a display area 200, pixels 201 are provided in a shape of a matrix. To the pixel 201, a signal line 202 and a gate line group 203 are connected. One end of the signal line 202 is connected to a signal-current generating circuit SGEN, and one end of the gate line group 203 is connected to a scanning circuit SCN. In practice, a number of pixels 201 are provided in the display area 200. However, for simplification of the drawing, only one pixel is shown in FIG. 9. In the signal line 202, parasitic capacitance $C_s$ exists. Although a power source line and a common ground electrode are also provided for the pixel 201 as will be described later, they are not shown in the drawing. Although the gate line group 203 is constructed by a plurality of gate lines in reality, only one line is shown for simplification.

The operation of the prior art shown in FIG. 9 will now be described. The scanning circuit SCN sequentially scans the gate line group 203, thereby selecting a pixel row to which a display signal current Isig is passed. Synchronously, the signal-current generating circuit SGEN supplies the display signal current Isig to the signal line 202, so that the display signal current Isig is passed to the selected pixel 201.

The structure and operation of the pixel 201 will be described with reference to FIG. 10.

FIG. 10 is a circuit configuration diagram of the pixel 201. Each of the pixels 201 is provided with an organic electroluminescent (EL) device 210 as a light emitting device. The cathode terminal of the organic EL device 210 is connected to a common ground 217. The anode terminal is connected to a power source line 216 via a channel of a drive TFT (Thin-Film-Transistor) 211 and a power source switch 215. The source terminal side of the drive TFT 211 is further connected to the signal line 202 via a write switch 214. Between the source terminal and the gate terminal of the drive TFT 211, a signal electric-carrier storage capacitor Csig is provided. Between the drain terminal and the gate terminal, a reset switch 212 is provided. The power source switch 215, write switch 214, and reset switch 212 are scanned by the gate line group 203.

The operation of the pixel shown in FIG. 10 will now be described. At the time of writing the display signal current Isig to the pixel 201, by the gate line group 203, the power source switch 215 is set to an off state, and the write switch 214 and the reset switch 212 are set to an on state. When the display signal current Isig is passed to the signal line 202 at this timing, the display signal current Isig flows into the organic EL device 210 via the channel of the drive TFT 211. At this time, a gate voltage difference corresponding to the value of the passed display signal current Isig occurs between the source terminal and the gate terminal of the drive TFT 211. After that, when the write switch 214 and the reset switch 212 are switched to the off state, a gate voltage signal corresponding to the value of the passed display signal current Isig which is generated between the source terminal and the gate terminal of the drive TFT 211 is held as it is in the signal electric-carrier storage capacitor Csig.

The above is the writing operation. After that, when the power source switch 215 is turned on by the gate line group 203, a voltage from the power source line 216 is supplied to the source terminal of the drive TFT 211, so that the drive TFT 211 applies the display signal current Isig corresponding to the gate voltage signal held in the signal electric-carrier storage capacitor Csig to the organic EL device 210. By the application, for the subsequent display period, the organic EL device 210 continuously illuminates with predetermined brightness.

Such a prior art is described in detail in, for example, "Digest of Technical Papers, IEDM 98, pp. 875-878).

The first prior art, however, has a problem such that it takes much time to pass a signal current to a selected pixel and increase in the number of pixels of the light emitting display device cannot be addressed.

Generally, a signal current used for driving the organic EL device in one pixel is 500 nA or less. When display precision of 50 gradations is assumed, writing with the minimum signal current of 10 nA is necessary. However, the parasitic capacitance Cs of a signal line is generally 10 pF or larger. For example, to write a signal shift of 100 mV with a signal current of 10 nA, a time constant is as large as 100 μsec. When time which is three times as long as the time constant is assumed for writing, 300 μsec is necessary to write pixels in one row. Consequently, when moving picture display of 60 frames/sec is assumed, the maximum number of pixel rows which can be written in a real time manner is only 56.

A second prior art to be described with reference to FIGS. 11 and 12 has been proposed to solve such a problem.

FIG. 11 is a diagram showing a general configuration of a light emitting display device as the second prior art. Since the configuration and operation of the second prior art are almost the same as those of the first prior art described above with reference to FIG. 9, the same reference numerals are given to similar components and the description will not be repeated. The second prior art is different from the first prior art with respect to the point that the signal-current generating circuit SGEN passes a signal current of Isig×K to the signal line 202. The signal current Isig is the value of display signal current for driving the organic EL device 210.

The structure and operation of a pixel 201A will be described with reference to FIG. 12.

FIG. 12 is a circuit configuration diagram of the pixel 201A. Each pixel 201A is provided with the organic EL device 210 as a light emitting device. The cathode terminal of the organic EL device 210 is connected to the common ground 217, and the anode terminal is connected to the power source line 216 via a channel of the drive TFT 211. The source terminal and the gate terminal of the drive TFT 211 are connected to the source terminal and the gate terminal of the write TFT 228, respectively. Between the source terminal and the gate terminal of the drive TFT 211, the signal electric-carrier storage capacitor Csig is provided. Between the drain terminal and the gate terminal of the write TFT 228, a reset switch 222 is provided. The drain terminal of the write TFT 228 is connected to the signal line 202 via a write switch 224. The write switch 224 and the reset switch 222 are scanned by the gate line group 203.

In the second prior art, it should be noted that the drive TFT 211 and the write TFT 228 have a so-called pair transistor configuration in which their source terminals and gate terminals are commonly connected, and the W/L (gate width/gate length) ratio of the write TFT 228 is designed to be K times as high as that of the drive TFT 211.

The operation of the pixel shown in FIG. 12 will now be described. At the time of passing the display signal current Isig×K to the pixel 201A, by the gate line group 203, the write switch 224 and the reset switch 222 are set to the on state. When the display signal current Isig×K is passed to the signal line 202 at this timing, the display signal current Isig×K flows from the power source line 216 to the signal line 202 via the channel of the write TFT 228. At this time, a gate voltage difference corresponding to the value of the passed display signal current Isig×K occurs between the source terminal and the gate terminal of the write TFT 228. At the same time, between the source terminal and the gate terminal of the drive TFT 211, a gate voltage difference corresponding to the value of the passed display signal current Isig occurs.

The reason why the value of the signal current Isig which is generated in the drive TFT 211 is 1/K of the signal current value of the write TFT 228 is because the W/L (gate width/gate length) ratio of the write TFT 228 is designed to be K times as high as that of the drive TFT 211 as described above.

When the write switch 224 and the reset switch 222 are switched to the off state, the gate voltage signal corresponding to the value of the passed display signal current Isig×K which is generated between the source terminal and the gate terminal of the write TFT 228 is held as it is in the signal electric-carrier storage capacitor Csig. At this time, the drive TFT 211 applies the display signal current Isig to the organic EL device 210 in correspondence with the gate voltage signal held in the signal electric-carrier storage capacitor Csig. By the application, for the subsequent display period, the organic EL device 210 continuously illuminates with predetermined brightness.

Such a prior art is described in detail in, for example, "Digest of Technical papers, SID 01, pp. 384-387".

SUMMARY OF THE INVENTION

By using the second prior art, the value of signal current can be increased by K times and the write time constant can be shortened to 1/K. In the second prior art, however, a write TFT having a large W/L dimension has to be provided within a pixel, so that the technique is not suited to realize higher precision of pixels. For example, the W/L dimension of the write TFT has to be designed to be larger than that of a drive TFT by one digit. Since the write TFT and the drive TFT are a pair of transistors, the gate length L has to be basically the same. The gate width W of the write TFT accordingly is larger than that of the drive TFT by one digit. It is therefore difficult to reduce the size of the pixel and to realize a high-precision light emitting display device.

Further, in the two prior arts, it is difficult to construct a pixel only by n-channel transistors and there is a problem such as high cost due to employment of a p-channel transistor. Since an Si-TFT in the n-channel transistor has current drive capability higher than that of the p-channel transistor, a pixel of a smaller area can be realized by the n-channel transistor circuit and the manufacturing cost considering also yield can be reduced. However, in an organic EL device, generally, the cathode electrode is connected to the commonly ground, so that a transistor gain cannot be obtained unless driven by the p-channel transistor. In other words, in the case of using the n-channel transistor for the drive TFT, the organic EL device is provided as a load on the source side, so that the organic EL device cannot be driven with current.

An object of the invention is, therefore, to provide an image display device capable of realizing both a larger number of pixels and higher precision.

Another object of the invention is to provide an image display device in which a pixel is constructed by an n-channel transistor to realize reduction in the manufacturing cost considering also the yield.

The above and other objects of the invention will become apparent from the following detailed description and the appended claims with reference to the attached drawings.

DETAILED DESCRIPTION OF THE PREFERRED EMBODIMENTS

Preferred embodiments of an image display device according to the invention will be described in detail hereinbelow with reference to the appended drawings.

First Embodiment

A first embodiment of the invention will be described with reference to FIGS. 1 to 4.

First, by referring to FIG. 1, the general configuration and operation of the embodiment will be described.

Figure 1:
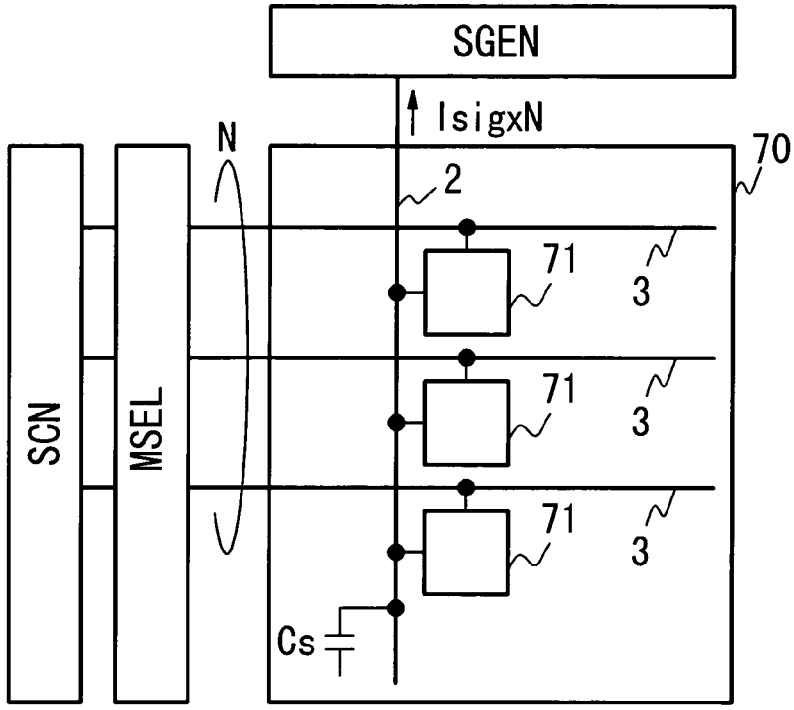
FIG. 1 is a diagram showing a general configuration of an OLED display panel as a first embodiment.

FIG. 1 is a diagram showing the general configuration of an organic light emitting diode (OLED) of the embodiment. In a display area 70, pixels 71 are provided in a shape of a matrix. To each of the pixels 71, a signal line 2 and a gate line group 3 are connected. One end of the signal line 2 is connected to a signal-current generating circuit SGEN and one end of the gate line group 3 is connected to a scanning circuit SCN via an N-pixels simultaneous multiple selection circuit MSEL for simultaneously selecting N pixels. Although a number of pixels 71 are provided in the display area 70 in practice, to simplify the drawing, only three pixels are shown in FIG. 1. In the signal line 2, the parasitic capacitance Cs exists. Although a power source line and a common ground electrode are also connected to the pixel 71 as will be described later, they are not shown here. The gate line group 3 is constructed by a plurality of gate lines in reality but only one gate line is shown for simplification.

The signal-current generating circuit SGEN is realized by the LSI (Large Scale Integrated circuit) technique which is conventionally well known, by using a digital-to-analog (DA) converter and a constant current power circuit and is mounted on a glass substrate. The scanning circuit SCN and the N pixels simultaneous multiple selection circuit MSEL are realized on a glass substrate by using the polysilicon TFT technique using a known shift register circuit and a proper logic circuit.

Figure 11:
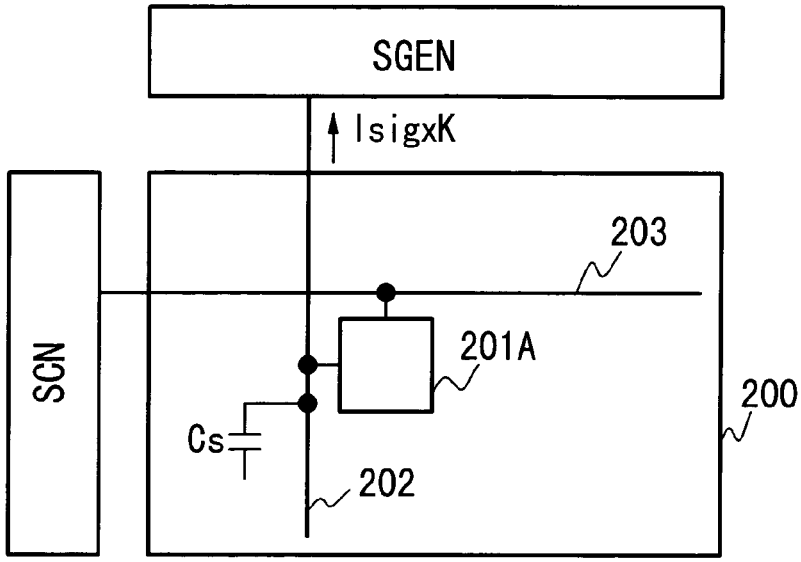
FIG. 11 is a diagram showing a general configuration of a light emitting display device as a second prior art.
Figure 12:
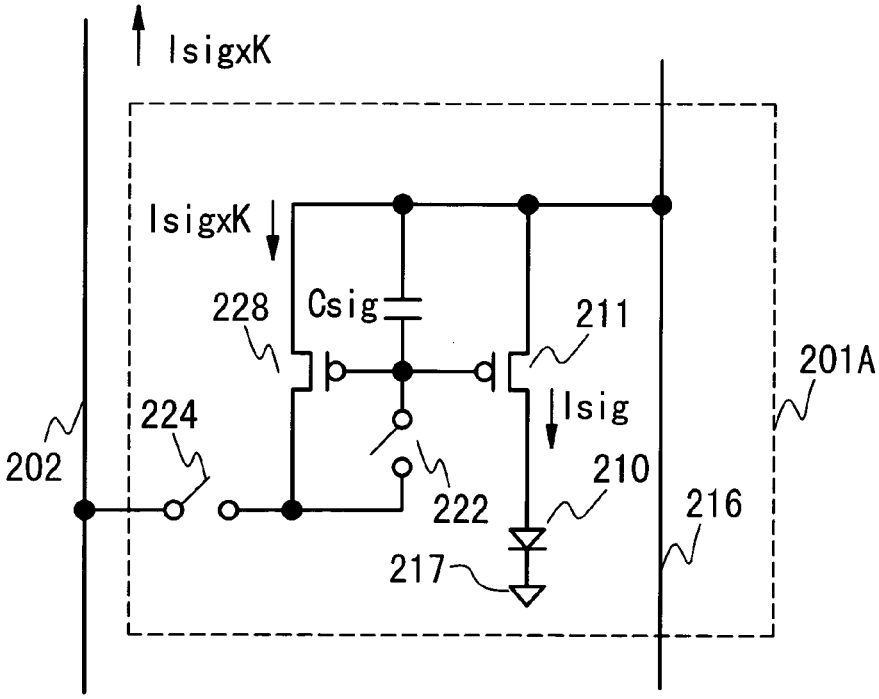
FIG. 12 is a diagram showing a pixel circuit configuration of the second prior art.

The operation of the display panel of the embodiment shown in FIG. 1 will be described. The scanning circuit SCN sequentially scans the gate line groups 3. When the scanning circuit SCN selects one gate line group 3, in response to the selection, the N pixels simultaneous multiple selection circuit MSEL selects the continuous N gate line groups 3, thereby selecting N pixel rows to which the display signal current is to be passed. The number of pixel rows simultaneously selected is expressed as N. Synchronously, the signal-current generating circuit SGEN passes display signal current Isig×N to the signal line 2, so that as an average, the display signal current Isig is passed to each of the selected pixels 71. The direction of the signal current Isig×N output from the signal-current generating circuit SGEN is the direction of current output from the pixel in a manner similar to the second prior art shown in FIG. 11.

The structure and operation of the pixel 71 will now be described with reference to FIG. 2.

Figure 2:
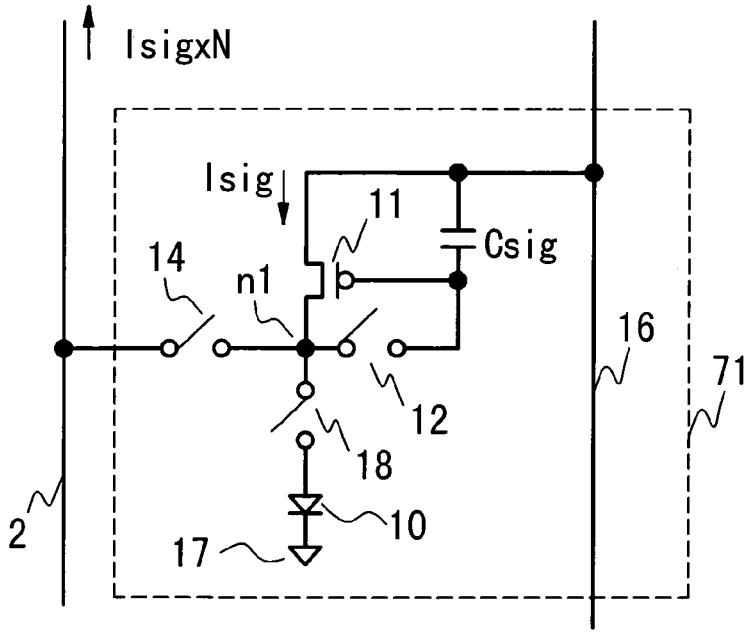
FIG. 2 is a diagram showing the configuration of a pixel circuit in the first embodiment.

FIG. 2 is a circuit configuration diagram of the pixel 71. In each of the pixels 71, an organic EL device 10 as a light emitting device is provided. The cathode terminal of the organic EL device 10 is connected to a common ground 17. The anode terminal is connected to a power source line 16 via a lighting switch 18 and the channel of a drive TFT 11. The drain terminal side of the drive TFT 11 is connected to the signal line 2 via a write switch 14. Between the source terminal and the gate terminal of the drive TFT 11, the signal electric-carrier storage capacitor Csig is provided. Between the drain terminal and the gate terminal, a reset switch 12 is provided.

Specifically, the anode of the organic EL device 10 is connected to a node n1, the node n1 is connected to the signal line 2 via the switch 14, and the node n1 is further connected to the power source line 16 via the channel of the drive TFT having the signal electric-carrier storage capacitor Csig between the gate and source.

The lighting switch 18, write switch 14, and reset switch 12 are scanned by the gate line group 3. The drive TFT 11, lighting switch 18, write switch 14, and reset switch 12 are constructed on the glass substrate by using polycrystalline Si-TFTs. Since a method of manufacturing the polycrystalline Si-TFT and the organic EL device 10 is not largely different from a generally reported method, its description will not be given here.

The operation of the pixel will now be described. At the time of passing the display signal current Isig to the pixel 71, the write switch 14 and the reset switch 12 are set to the on state by the gate line group 3. When the display signal current Isig×N is passed to the signal line 2 at this timing, the display signal current Isig×N is generated by adding average currents Isig of the selected N pixels.

Therefore, when attention is paid to one pixel, the display signal current Isig is passed from the power source line 16 into the channel of the drive TFT 11. At this time, a gate voltage difference corresponding to the value of the written display signal current Isig occurs between the source terminal and the gate terminal of the drive TFT 11. When the write switch 14 and the reset switch 12 are switched to the off state, the gate voltage signal corresponding to the value of the display signal current Isig written which is generated between the source terminal and the gate terminal of the drive TFT 11 is held as it is in the signal electric-carrier storage capacitor Csig.

The above is the writing operation. After that, when the lighting switch 18 is turned on by the gate line group 3, the organic EL device 10 is connected to the drain terminal of the drive TFT 11. Consequently, the drive TFT 11 applies the display signal current Isig corresponding to the gate voltage signal held in the signal electric-carrier storage capacitor Csig from the power source line 16 to the organic EL device 10. For the application, for the subsequent display period, the organic EL device 10 continuously illuminates with predetermined brightness.

A driving sequence of the write switch 14, reset switch 12, and lighting switch 18 will now be described while being compared with operations between pixels adjacent to each other in the column direction.

Figure 3:
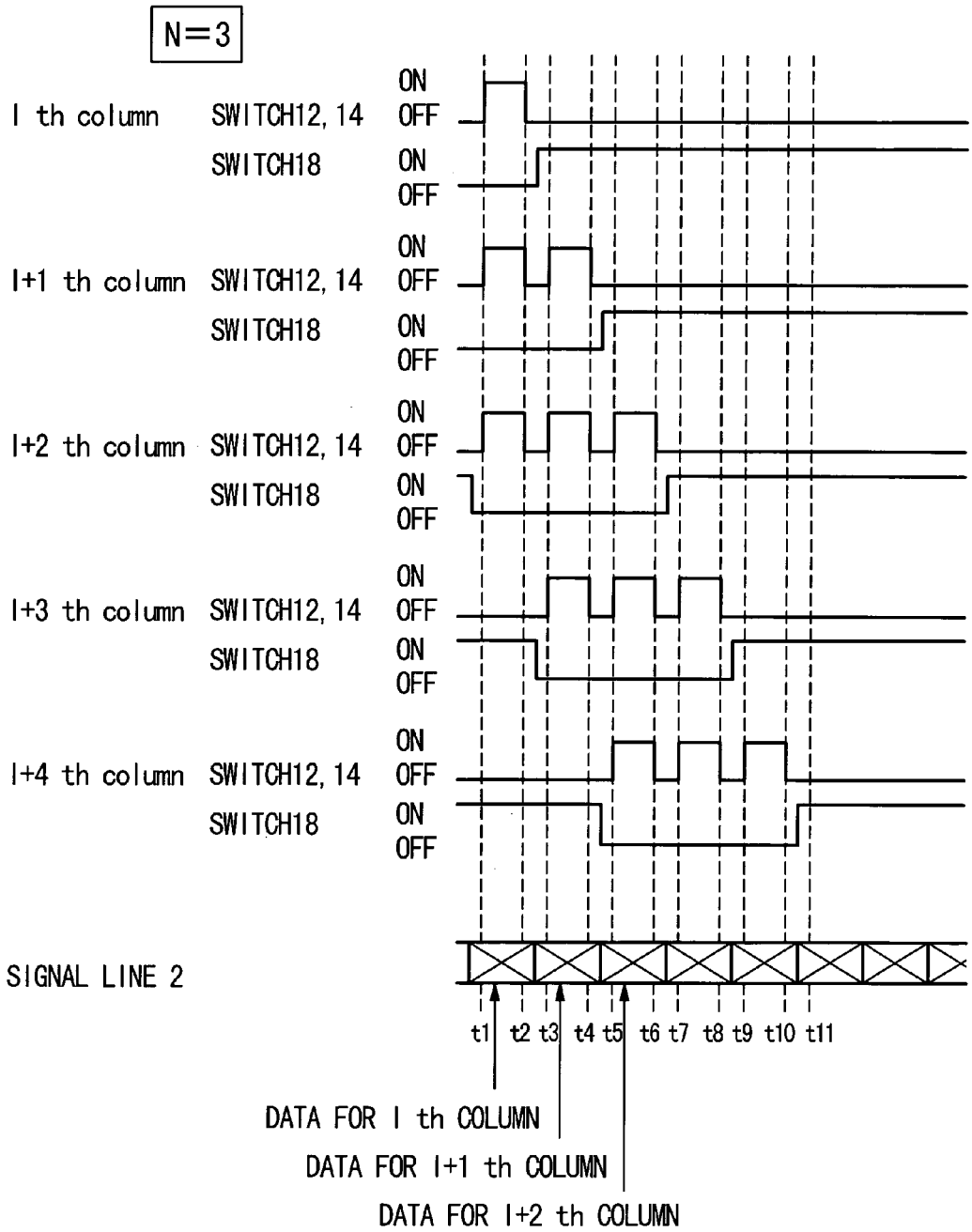
FIG. 3 is a timing chart showing driving timings of switches in the pixel in the first embodiment.

FIG. 3 is a driving timing chart of the write switch 14, reset switch 12, and lighting switch 18. The horizontal axis denotes time and the vertical axis shows timings of the operation of switches of pixels in five columns from an arbitrary I-th column to a (I+4)th row and the operation of the signal line 2. The chart shows the case where the number N of columns of pixels selected by the N pixels simultaneous multiple selection circuit MSEL is 3 (N=3). An on state and an off state of each of the switches are shown as an upward wave and a downward wave, respectively, in the timing chart.

Although the number N of columns of pixels selected simultaneously is 3 in the embodiment, N may be an arbitrary value from 2 to the number of pixels in the column direction. In reality, however, the lighting switch 18 has to be turned on for a certain period of time to thereby assure brightness, so that N is desirably the half of the number of pixels in the column direction or less.

The operations of the switches at timings t1 to t11 shown in FIG. 3 will be described hereinbelow.

At timing t1, when the write switches 14 and the reset switches 12 of pixels in three columns from the I-th column to the (I+2)th column are turned on by the scanning circuit SCN, the signal-current generating circuit SGEN passes the display signal current Isig×N which is N times to the signal line 2. The display signal current Isig is data to be input to the pixels in the I-th column.

At timing t2, when the write switches 14 and the reset switches 12 of pixels in three columns from the I-th column to the (I+2)th column are turned off, the display signal current Isig to be input to the pixels in the I-th column is stored in the pixels of three columns from the I-th column to the (I+2)th column.

Between the timings t2 and t3, the lighting switch 18 of the pixels in the Ith column is turned on, lighting of the pixel in the I-th column is started and, simultaneously, the lighting switch 18 in the (I+3)th column on which writing operation is to be performed is turned off, thereby completing passing of the display signal current Isig to the pixel in the I-th column.

At timing t3, when the write switches 14 and the reset switches 12 of pixels in three columns from the (I+1)th column to the (I+3)th column are turned on by the scanning circuit SCN, the signal-current generating circuit SGEN passes the N-times display signal current Isig×N which is N times to the signal line 2. The display signal current Isig is data to be input to the pixel in the (I+1)th column.

Subsequently, at timing t4, when the write switches 14 and the reset switches 12 of the pixels in the three columns from the (I+1)th column to the (I+3)th column are turned off, the display signal current Isig to be input to the pixel in the (I+1)th column is stored in the pixels in the three columns from the (I+1)th column to the (I+3)th column.

Between the timings t4 and t5, the lighting switch 18 of the pixel in the (I+1)th column is turned on, lighting of the pixel in the (I+1)th column is started and, simultaneously, the lighting switch 18 of the pixel in the (I+4)th column on which writing operation is to be performed is turned off. After that, the writing of the display signal current Isig to the pixel in the (I+1)th column is completed.

At timing t5, when the write switches 14 and the reset switches 12 of the pixels in three columns from the (I+2)th column to the (I+4)th column are turned on by the scanning circuit SCN via the N pixels simultaneous multiple selection circuit MSEL, the signal current generating circuit SGEN passes the display signal current Isig×N of N times to the signal line 2. The display signal current Isig is data to be input to the pixel in the (I+2)th column.

Subsequently, at timing t6, when the write switches 14 and the reset switches 12 of the pixels in the three columns from the (I+2)th column to the (I+4)th column are turned off, the display signal current Isig to be input to the pixel in the (I+2)th column is stored in the pixels in the three columns from the (I+2)th column to the (I+4)th column.

Between the timings t6 and t7, the lighting switch 18 of the pixel in the (I+2)th column is turned on, lighting of the pixel in the (I+2)th column is started and, simultaneously, the lighting switch 18 of the pixel in the (I+5)th column on which writing operation is to be performed is turned off. After that, the writing of the display signal current Isig to the pixel in the (I+2)th column is completed.

As described above, between the timings t8 and t9, the display signal current Isig is passed to the pixel in the (I+3)th column. Between the timings t10 and t11, the display signal current Isig is passed to the pixel in the (I+4)th column. In the embodiment, the display signal current Isig is passed N times to each of the pixels in one frame period. It should be noted that the pixels are turned on based on the value of the display signal current Isig of the last time of the N times.

At timing t11 and subsequent timings, the writing and starting of lighting are similarly continued. In a last part of the pixel column, scan of the pixel in the first column is started again. As a result, writing of the display signal current to the N pixels is always executed.

As described above, in the embodiment, the number N of columns of pixels simultaneously selected is fixed to three. However, the number N may be arbitrarily changed.

Although the lighting switches 18 are turned on in order from the pixel columns on which writing is completed in the embodiment, the lighting switches 18 can be also turned on at once upon completion of writing to all of the pixels. In this case, by increasing the time in which the pixels are not turned on, dynamic resolution can be improved. Such a method of driving the lighting switches 18 may be switched according to the kind of an image displayed and selection of the user.

By using the embodiment, the value of signal current can be increased by N times. Even if the parasitic capacitance Cs exists in the signal line 2, the write time constant to the signal line can be shortened to 1/N. In the embodiment, it is unnecessary to provide a TFT having large dimensions in a pixel as in the second prior art, and higher precision of pixels can be easily achieved.

In the invention, the display signal current Isig to be passed to the pixels is desirably distributed equally to the N pixels to be written. Consequently, the drive TFTs 11 of the N pixels to be written have to be fabricated so that their characteristics do not change from each other so much. The TFT fabricating technique for this purpose will be described hereinbelow.

As described above, the drive TFT 11 is provided on the glass substrate by using the polycrystalline Si-TFT technique. As disclosed in a number of documents, according to the polycrystalline Si-TFT technique, an amorphous Si thin film formed on a glass substrate is irradiated with a laser beam shaped in an almost rectangular shape, thereby crystallizing the film into a polycrystalline Si-TFT thin film. By using the polycrystalline Si-TFT thin film as a channel layer, a TFT is fabricated. Characteristics of polycrystalline Si-TFTs fabricated as described above vary due to fluctuations in laser irradiation energy used at the time of polycrystallization. In the embodiment, however, it is demanded to fabricate the drive TFTs 11 so that the characteristics of the drive TFTs 11 of the N pixels to be written do not vary so much. Therefore, the following TFT fabricating technique is employed.

Figure 4:
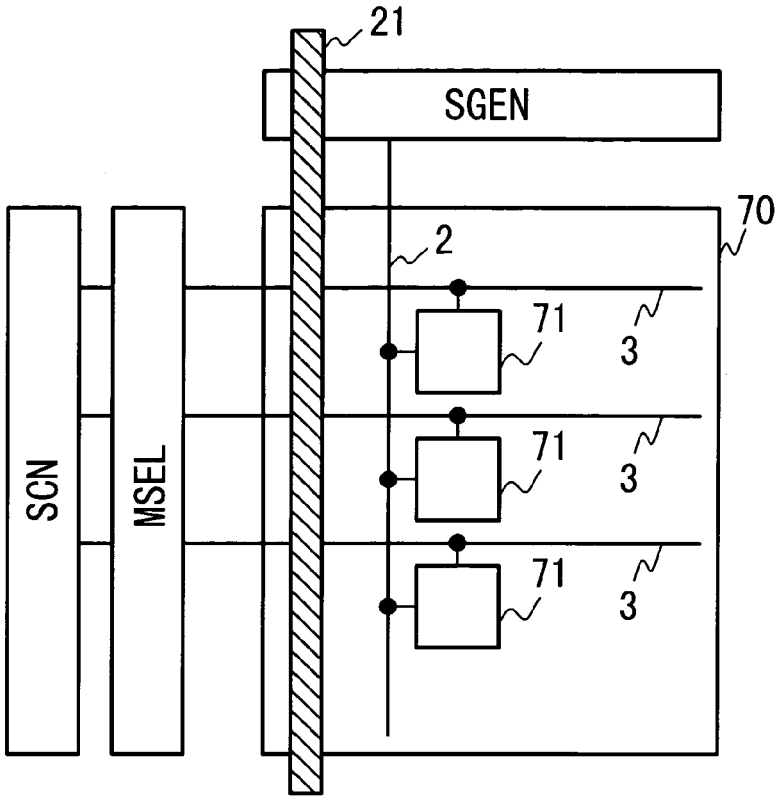
FIG. 4 is a schematic diagram of a laser emitting process in a process of manufacturing the OLED display panel of the first embodiment.

FIG. 4 schematically shows a state where an amorphous Si thin film formed on a glass substrate is irradiated with a laser beam shaped in an almost rectangular shape so as to be crystallized as a polycrystalline SI-TFT thin film. Since a laser irradiating process is a process of forming a channel layer of a TFT, in an actual laser irradiating process, the display area 70, pixel 71, signal line 2, gate line group 3, signal-current generating circuit SGEN, scanning circuit SCN, and the like are not formed. Consequently, those structures shown in the diagram are to be formed later.

In FIG. 4, an amorphous Si thin film is formed in advance. A long side of an almost rectangular shape 21 of a laser beam to be irradiated is specified in parallel with the signal line 2. When a laser beam of such a shape is emitted, although laser irradiation energy varies on the time base, the laser irradiation energy in a certain moment hardly varies in a plane, so that variations in the characteristics of the drive TFTs 11 of the N pixels connected to the same signal line 2 can be reduced.

The foregoing embodiment can be variously changed without departing from the gist of the invention. For example, a glass substrate is used as a TFT substrate in the embodiment, another transparent insulating substrate such as a quartz substrate or a transparent plastic substrate may be used. By arranging the organic EL device 10 so as to emit light from the top face of the substrate, an opaque substrate can be also used.

In the description of the embodiment, the number of pixels, the panel size, and the like are not particularly mentioned for the reason that the present invention is not limited to specifications and formats.

In the embodiment, the signal-current generating circuit SGEN is mounted on the glass substrate realized by the LSI technique using the DA converter and the constant current source circuit. The scanning circuit SCN, the N pixels simultaneous multiple selection circuit MSEL, and the pixels 71 are constructed by low-temperature polycrystalline Si-TFT circuits. Alternately, it is also possible within the scope of the invention to construct the signal-current generating circuit SGEN by the low-temperature polycrystalline Si-TFT circuit and to construct the scanning circuit SCN and the N pixels simultaneous multiple selection circuit MSEL or a part of them by single-crystal LSI circuits.

Although the organic EL device 10 is used as a light emitting device in the embodiment, obviously, the invention can be also realized by using various light emitting devices driven by current including inorganic light emitting devices.

The various changes are not limited to the foregoing embodiment but can be also basically similarly applied to the following other embodiments.

Second Embodiment

A second embodiment of the invention will be described hereinbelow with reference to FIGS. 5 and 6.

Since the general configuration and operation of the second embodiment are similar to those of the foregoing first embodiment, the same reference numerals are given to similar components and their detailed description will not be repeated here.

The second embodiment is different from the first embodiment with respect to the structure and operation of pixels. The structure and operation of a pixel 71A will be described hereinbelow with reference to FIG. 5.

Figure 5:
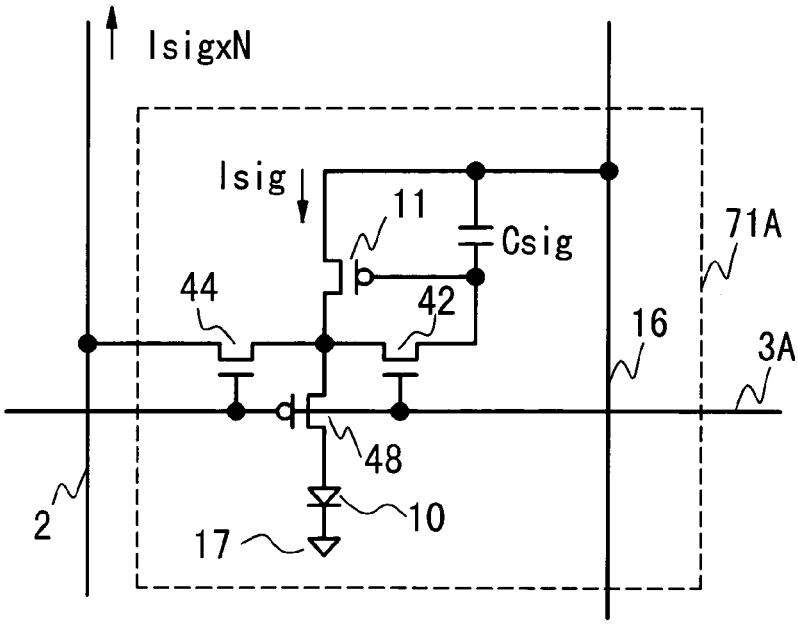
FIG. 5 is a diagram showing the configuration of a pixel circuit in a second embodiment.

FIG. 5 is a circuit configuration diagram of the pixel 71B. Each pixel 71A is provided with the organic EL device 10 as a light emitting device. The cathode terminal of the organic EL device 10 is connected to the common ground 17, and the anode terminal is connected to the power source line 16 via a lighting switch 48 and the channel of the drive TFT 11. The drain terminal side of the drive TFT 11 is connected to the signal line 2 via a write switch 44. Between the source terminal and the gate terminal of the drive TFT 11, the signal electric-carrier storage capacitor Csig is provided. Between the drain terminal and the gate terminal of the drive TFT 11, a reset switch 42 is provided.

The lighting switch 48, write switch 44, and reset switch 42 are scanned by a gate line 3A. The drive TFT 11, lighting switch 48, write switch 44, and reset switch 42 are formed on the glass substrate by using polycrystalline Si-TFTs. The lighting switch 48 is constructed by, as shown in the diagram, a p-channel transistor. Each of the write switch 44 and the reset switch 42 is constructed by an n-channel transistor. The gate electrodes of the lighting switch 48, write switch 44, and reset switch 42 are connected to each other and connected to the gate line 3A. The gate line 3A is a wiring line provided for each pixel column.

The operation of the pixel shown in FIG. 5 will now be described. At the time of passing the display signal current Isig to the pixel 71A, when the gate line 3A is set to a high voltage level (hereinbelow, for convenience, the state will be called as an on state of the gate line 3A) the write switch 44 and the reset switch 42 are set to the on state, and the lighting switch 48 is set to the off state. When the display signal current Isig×N is passed to the signal line at this timing, the display signal current Isig×N is generated by adding average currents Isig of the selected N pixels.

Therefore, when attention is paid to one pixel, the display signal current Isig is passed from the power source line 16 into the channel of the drive TFT 11. At this time, a gate voltage difference corresponding to the value of the written display signal current Isig occurs between the source terminal and the gate terminal of the drive TFT 11.

When the gate line 3A is set to a low-voltage level (hereinbelow, for convenience, this state will be called an off state of the gate line 3A), the write switch 44 and the reset switch 42 are switched to the off state, and the lighting switch 48 is switched to the on state. The gate voltage signal corresponding to the value of the written display signal current Isig which is generated between the source terminal and the gate terminal of the drive TFT 11 is held as it is in the signal electric-carrier storage capacitor Csig. The writing operation has been described above.

Simultaneously, the organic EL device 10 is connected to the drain terminal of the drive TFT 11, so that the drive TFT 11 passes the display signal current Isig corresponding to the gate voltage signal held in the signal electric-carrier storage capacitor Csig from the power source line 16 to the organic EL device 10. For the application, for the subsequent display period, the organic EL device 10 continuously illuminates with predetermined brightness.

A driving sequence of the gate line 3A for controlling the write switch 44, reset switch 42, and lighting switch 48 will be described while being compared with operations between nearby pixels adjacent to each other in the column direction.

Figure 6:
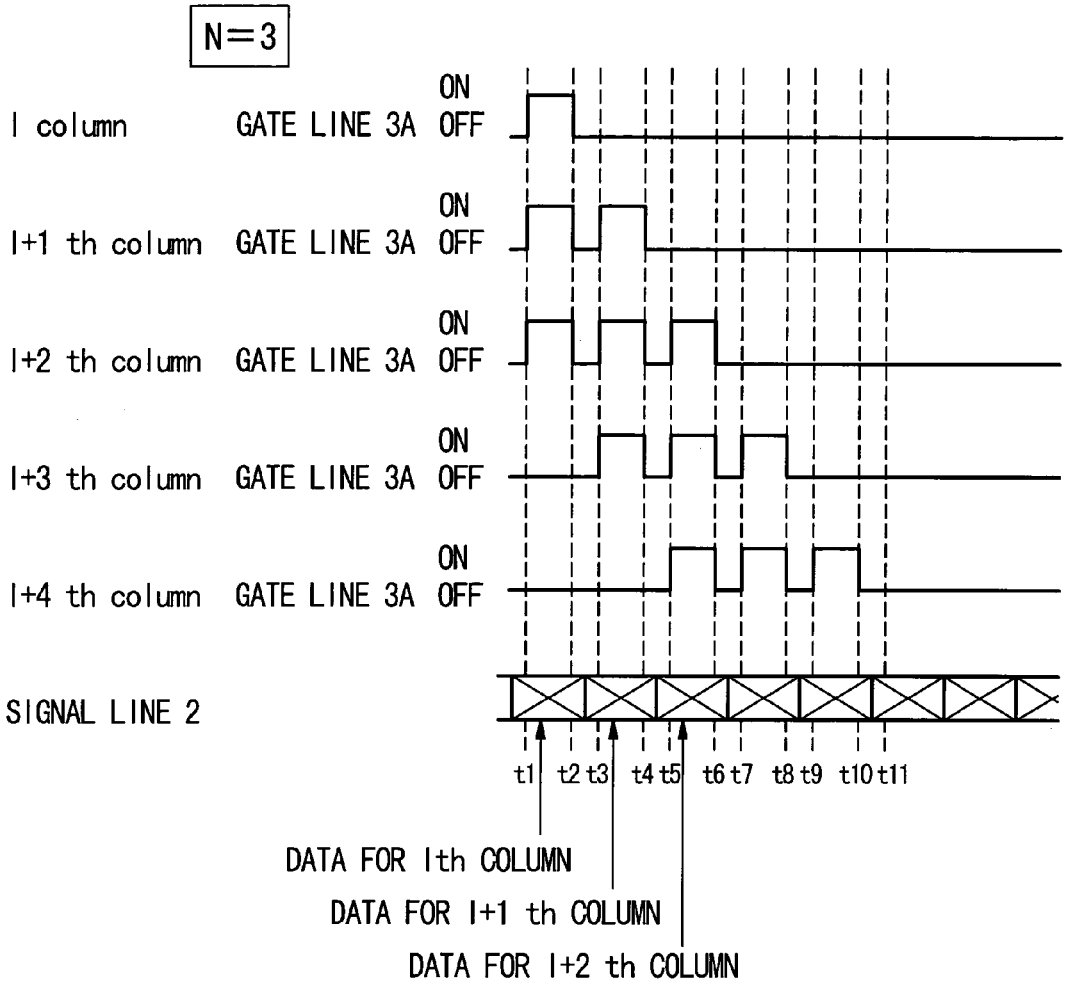
FIG. 6 is a timing chart showing driving timings of switches in the pixel in the second embodiment.

FIG. 6 is a timing chart showing the driving timings of the gate line 3A for controlling the write switch 44, reset switch 42, and lighting switch 48. The horizontal axis denotes time and the vertical axis shows operation timings of the gate lines 3A of pixels in five columns from an arbitrary I-th column to the (I+4)th column and the signal line 2. As described above, a state where the gate line 3A is set to the high voltage level is regarded as an on state of the gate line 3A, and a state where the gate line 3A is set to the low voltage level is regarded as an off state of the gate line 3A. The on and off states are shown as an upward wave and a downward wave, respectively, in the timing chart. Although the number N of columns of pixels selected simultaneously is set to 3 also in the embodiment, obviously, in the invention, N may be 2 or larger and an arbitrary number which is equal to or smaller than the number of pixels in the row direction.

The operations of the switches at timings t1 to t11 shown in FIG. 6 will be described hereinbelow. At timing t1, when the gate lines 3A of three columns from the I-th column to the (I+2)th column are turned on by the scanning circuit SCN (not shown), the signal-current generating circuit SGEN (not shown) passes the display signal current Isig×N which is N times to the signal line 2. The display signal current Isig is data to be input to the pixel in the I-th column.

At timing t2, when the gate lines 3A from the I-th column to the (I+2)th column are turned off, the display signal current Isig to be supplied to the pixel in the I-th column is stored in the pixels in three columns from the I-th column to the (I+2)th column and, simultaneously, the, lighting switch 48 is turned on to start lighting, thereby completing the passing of the display signal current Isig to the pixel in the Ith column.

At timing t3, when the gate lines 3A of three columns from the (I+1)th column to the (I+3)th column are turned on by the scanning circuit SCN, the signal-current generating circuit SGEN passes the display signal current Isig×N of N times to the signal line 2. The display signal current Isig is data to be passed to the pixel in the (I+1)th column.

At timing t4, when the gate lines 3A from the (I+1)th column to the (I+3)th column are turned off, the display signal current Isig to be input to the pixel in the (I+1)th column is stored in the pixels in the three columns from the (I+1)th column to the (I+3)th column and, simultaneously, the lighting switch 48 is turned on to start lighting, thereby completing writing of the display signal current Isig to the pixel in the (I+1)th column.

At timing t5, when the gate lines 3A in three columns from the (I+2)th column to the (I+4)th column are turned on by the scanning circuit SCN, the signal current generating circuit SGEN passes the display signal current Isig×N of N times to the signal line 2. The display signal current Isig is data to be input to the pixel in the (I+2)th column.

Subsequently, at timing t6, when the gate lines 3B from the (I+2)th column to the (I+4)th column are turned off, the display signal current Isig to be input to the pixel in the (I+2)th column is stored in the pixels in the three columns from the (I+2)th column to the (I+4)th column and, simultaneously, the lighting switch 48 is turned on to start lighting, thereby completing writing the display signal current Isig to the pixel in the (I+2)th column.

Between the timings t7 and t8, the display signal current Isig is passed to the pixel in the (I+3)th column. Between the timings t9 to t10, the display signal current Isig is passed to the pixel in the (I+4)th column.

At timing t11 and subsequent timings, the writing and start of lighting are similarly continued. In a last part of the pixel column, scanning of the pixel in the first column is started again. Consequently, as a result, the display signal current is always passed to the N pixels.

As described above, in the embodiment, the number N of columns of pixels simultaneously selected is fixed to three. However, the number N may be arbitrarily changed.

Third Embodiment

A third embodiment of the invention will be described hereinbelow with reference to FIG. 7.

Since the general configuration and operation of the third embodiment are similar to those of the foregoing first embodiment, the same reference numerals are given to similar components and their detailed description will not be repeated here.

The third embodiment is different from the first embodiment with respect to the structure and operation of pixels. The structure and operation of a pixel 71B will be described hereinbelow with reference to FIG. 7.

Figure 7:
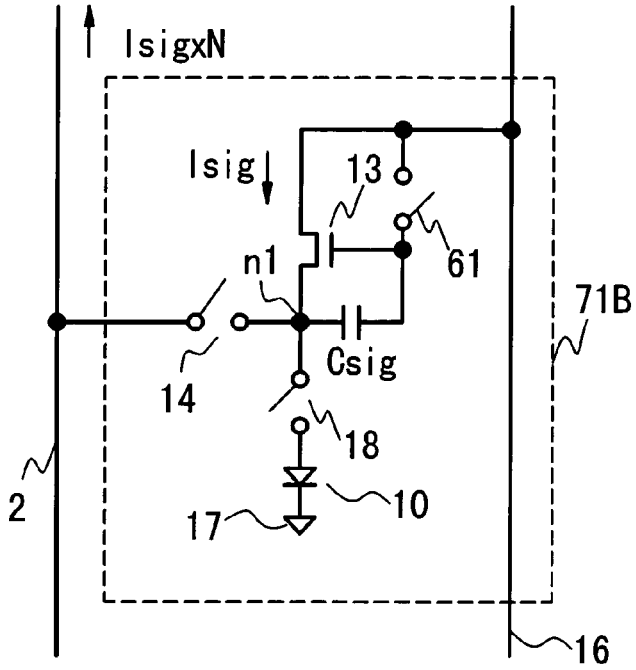
FIG. 7 is a diagram showing the configuration of a pixel circuit in a third embodiment.

FIG. 7 is a circuit configuration diagram of the pixel 71B. Each pixel 71B is provided with the organic EL device 10 as a light emitting device. The cathode terminal of the organic EL device 10 is connected to the common ground 17, and the anode terminal is connected to the power source line 16 via the lighting switch 18 and the channel of the drive TFT 13. The source terminal side of the drive TFT 13 is connected to the signal line 2 via the write switch 14. Between the source terminal and the gate terminal of the drive TFT 13, the signal electric-carrier storage capacitor Csig is provided. Between the drain terminal and the gate terminal of the drive TFT 13, a reset switch 61 is provided. The lighting switch 18, write switch 14, and reset switch 61 are scanned by the gate line group 3. The drive TFT 11, lighting switch 18, write switch 14, and reset switch 61 are constructed on the glass substrate by using polycrystalline Si-TFTs.

The operation of the pixel shown in FIG. 7 will now be described. At the time of passing the display signal current Isig to the pixel 71B, the write switch 14 and the reset switch 61 are set to the on state by the gate line group 3. When the display signal current Isig×N is passed to the signal line 2 at this timing, the display signal current Isig×N is generated by adding average currents Isig of the selected N pixels.

Therefore, when attention is paid to one pixel, the display signal current Isig is passed from the power source line 16 into the channel of the drive TFT 13. At this time, a gate voltage difference corresponding to the value of the passed display signal current Isig occurs between the source terminal and the gate terminal of the drive TFT 13. When the write switch 14 and the reset switch 61 are switched to the off state, the gate voltage signal corresponding to the value of the passed display signal current Isig which is generated between the source terminal and the gate terminal of the drive TFT 11 is held as it is in the signal electric-carrier storage capacitor Csig.

The above is the writing operation. After that, when the lighting switch 18 is turned on by the gate line group 3, the organic EL device 10 is connected to the source terminal of the drive TFT 13, so that the drive TFT 13 passes the display signal current Isig corresponding to the gate voltage signal held in the signal electric-carrier storage capacitor Csig from the power source line 16 to the organic EL device 10. For the subsequent display period, the organic EL device 10 continuously illuminates with predetermined brightness.

In the embodiment, since the drive TFT 13 is an n-channel transistor, when each of the lighting switch 18, write switch 14, and reset switch 61 is constructed by an n-channel transistor, the pixel can be constructed only by n-channel transistors. Therefore, cost reduction by not using the p-channel transistor can be realized. Since an Si-TFT in the n-channel transistor has current drive capability higher than that of the p-channel transistor, a pixel of a smaller area can be realized by the n-channel transistor and the manufacturing cost also considering yield can be reduced.

Generally, in an organic EL device, the cathode electrode is connected to the common grounded, so that a transistor gain cannot be easily obtained unless the organic EL device is driven by the p-channel transistor in the prior arts. In other words, in the case of using the n-channel transistor for the drive TFT, the organic EL device is provided as a load on the source side, so that it is difficult to drive the organic EL device with current accompanying gradation display.

In the embodiment, however, the anode terminal of the organic EL device 10 is connected to the first node n1 via the lighting switch 18, the first node n1 is connected to the signal line 2 via the write switch 14, and the first node n1 is further connected to the power source line 16 via the channel of the drive TFT 13. The drive TFT 13 employs the structure in which the reset switch 61 is provided between the gate and the drain, and the signal electric-carrier storage capacitor Csig is provided between the gate and source. At the time of writing the display signal current Isig, the organic EL device 10 is separated from the load of the drive TFT 13 by the lighting switch 18. At the time of lighting, the reset switch 61 is turned off. Consequently, the voltage between the source and gate terminals of the drive TFT 13 is specified by the signal electric-carrier storage capacitor Csig. Therefore, the organic EL device 10 does not become a load on the drive TFT 13 and the gain is not decreased.

In particular, the substrate is an insulator made of glass or the like, and parasitic capacitance is small, so that such a circuit configuration can function especially effectively.

In the third embodiment as well, in a manner similar to the foregoing embodiments, the signal current is passed simultaneously to pixels in N columns by using the N pixels simultaneous multiple selection circuit MSEL. The above-described advantage that a pixel can be constructed only by n-channel transistors is obtained without a pre-condition of passing the signal current simultaneously to pixels in N columns by using the N pixels simultaneous multiple selection circuit MSEL. Therefore, the circuit configuration described in the third embodiment having the advantage such that the pixel is constructed only by n-channel transistors can be also applied to an embodiment in which the signal current is not passed simultaneously to N pixels.

Fourth Embodiment

A fourth embodiment of the invention will be described with reference to FIG. 8.

Figure 8:
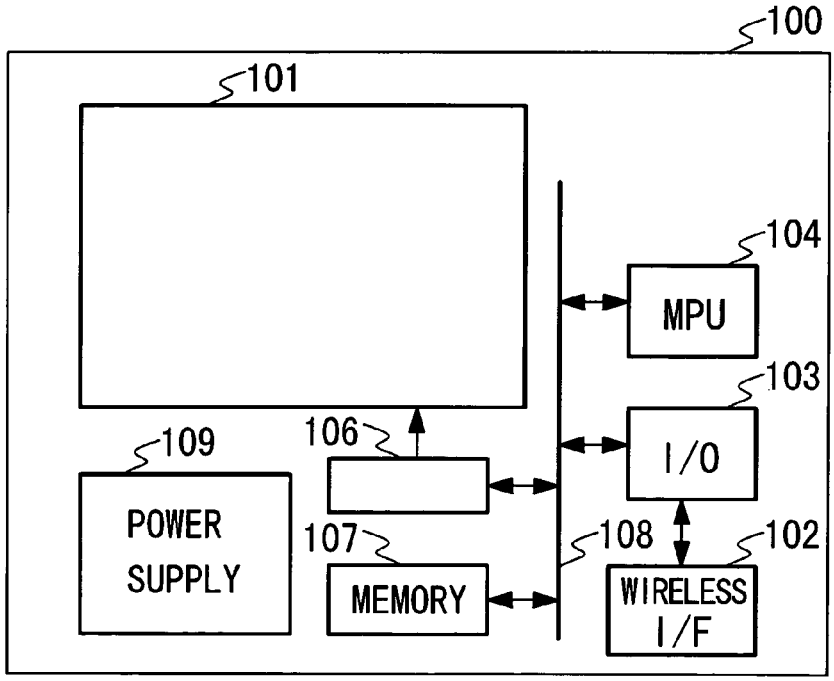
FIG. 8 is a diagram showing the configuration of an image display terminal as a fourth embodiment.
Figure 9:
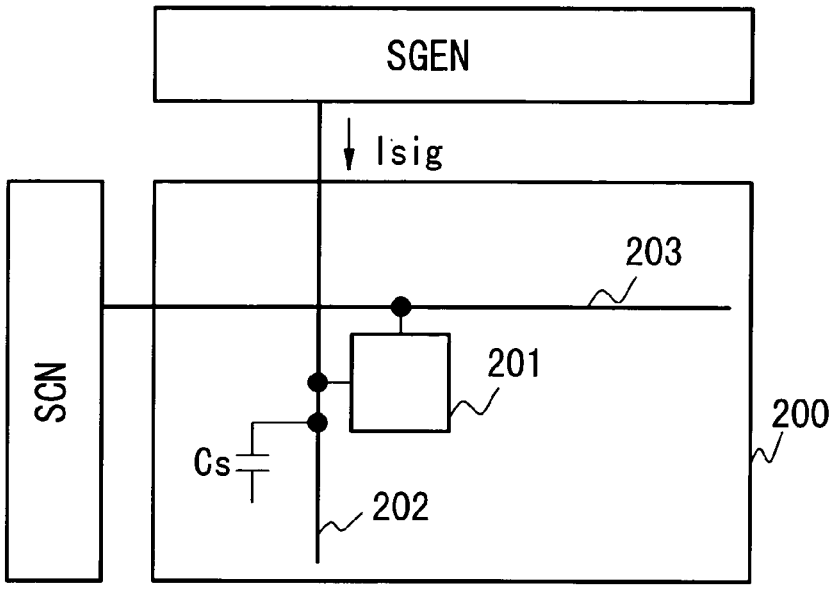
FIG. 9 is a diagram showing a general configuration of a light emitting display device as a first prior art.

FIG. 8 is a diagram showing the configuration of an image display terminal (PDA: Personal Digital Assistant) 100 as the fourth embodiment.

To a wireless interface (I/F) circuit 102, compressed image data or the like is input as wireless data based on a close-range wireless communication standard from the outside. An output of the wireless I/F circuit 102 is connected to a data bus 108 via an I/O (Input/Output) circuit 103. To the data bus 108, a microprocessor (MPU) 104, a display panel controller 106, a frame memory 107, and the like are also connected. An output of the display panel controller 106 is input to an OLED display panel 101. The image display terminal 100 further includes a power supply 109. Since the OLED display panel 101 has the same configuration and operation as those of the foregoing first embodiment, the description of the internal configuration and operation will not repeated here.

The operation of the embodiment will be described hereinbelow. First, the wireless I/F circuit 102 fetches compressed image data from the outside in accordance with an instruction and transfers the image data to the microprocessor 104 and the frame memory 107 via the I/O circuit 103. The microprocessor 104 receives the instruction of operation from the user, drives the whole image display terminal 100 as necessary, decodes and process the compressed image data, and displays information. The image data subjected to signal process is temporarily stored in the frame memory 107.

In the case where the microprocessor 104 gives a display instruction, in response to the instruction, image data is input to the OLED display panel 101 from the frame memory 107 via the display panel controller 106. On the OLED display panel 101, the input image data is displayed in a real-time manner. At this time, the display panel controller 106 simultaneously outputs predetermined timing pulses necessary to display an image. The power supply 109 includes a secondary battery and supplies power to drive the whole image display terminal 100.

According to the embodiment, the image display terminal 100 capable of performing high-precision multi-gradation display with a number of pixels can be provided.

In the fourth embodiment, the OLED display panel described in the first embodiment is used as an image display device. Obviously, various display panels described in the other embodiments of the invention can be alternately used.

Although the preferred embodiments of the invention have been described above, the invention is not limited to the foregoing embodiments but various design changes are possible without departing from the scope of the invention. For example, the invention can be also applied to the first prior art of FIG. 10.

Figure 10:
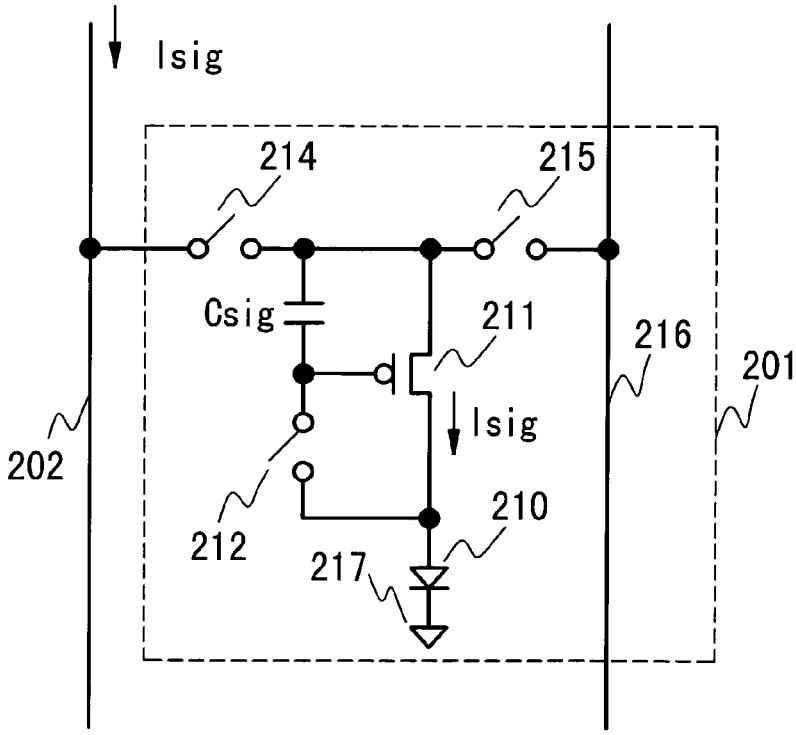
FIG. 10 is a diagram showing a pixel circuit configuration of the first prior art.

At the time of passing the display signal current Isig to the pixel 201 of FIG. 10, N pixels 201 selected by the gate line group 203 are selected. For the N pixels 201, the power source switch 215 is set to the off state, and the write switch 214 and the reset switch 212 are set to the on state. When the display signal current Isig×N is passed to the signal line 202 at this timing, for each of the selected pixels 201, the display signal current Isig flows in the organic EL device 10 via the channel of the drive TFT 211. At this time, between the source terminal and the gate terminal of the drive TFT 211, a gate voltage difference corresponding to the written display signal current Isig occurs. The direction of the signal current Isig×N output from the signal current generating circuit SGEN is the direction of current passed to the pixels.

After that, when the write switch 214 and the reset switch 212 are switched to the off state in the N pixels 201 selected, a gate voltage signal corresponding to the value of the written display signal current Isig which is generated between the source terminal and the gate terminal of the drive TFT 211 is held as it is in the signal electric-carrier storage capacitor Csig. After that, when the power source switch 215 is turned on by the gate line group 203, a voltage is supplied from the power source line 216 to the source terminal of the drive TFT 211. Consequently, the drive TFT 211 applies the display signal current Isig corresponding to the gate voltage signal held in the signal electric-carrier storage capacitor Csig to the organic EL device 10. By the application, for the subsequent display period, the organic EL device 10 continuously illuminates with predetermined brightness.

In such a manner, the present invention such that the display signal currents Isig which are almost equal to each other are passed to the N pixels 201 selected by the gate line group 203 and the signal current generating circuit SGEN can pass the display signal current Isig×N to the signal line 202 can be applied to the pixel circuit of the first prior art.

However, since the lighting switch 18 as described in the first embodiment is not provided, each of the pixels illuminates a little according to the value of the display signal current Isig each time the display signal current Isig is passed to the selected N pixels 201. Consequently, the embodiment has a disadvantage such that it is not easy to realize black display in a strict sense except for the time of total black display but has an advantage that the existing pixel circuit can be used as it is.

As obvious from the foregoing embodiments, according to the invention, a delay in writing due to the influence of the parasitic capacitance in the signal line as in the first prior art can be prevented and, moreover, it is unnecessary to provide a pair of transistors of a large size used in the second prior art in a pixel. Thus, an image display device capable of achieving high-precision display with a number of pixels can be provided.

Since a pixel can be constructed by n-channel transistors, in the case of using an n-channel transistor circuit, an image display device can be realized with a smaller area. Since probability of occurrence of a defect decreases, the device can be manufactured with high yield. Therefore, the manufacturing cost of the image display device can be decreased.

The image display device according to the invention is not limited to the foregoing embodiments but, obviously, various design changes and the like are possible without departing from the spirits of the invention.

What is claimed is:

1. An image display device comprising:

a pixel having a light emitting device which is driven to emit light on the basis of a display signal current;

a display unit constructed by a plurality of said pixels arranged in a matrix;

a signal line for passing said display signal current to said pixels;

write pixel selecting means for selecting at least one row or column of said pixels to which said display signal current is to be passed via said signal line from said plurality of pixels; and display signal current generating means for generating said display signal current, wherein said write pixel selecting means has a function of selecting N rows or columns of pixels simultaneously, N being an integer equal to or greater than 2.

2. The image display device according to claim 1, wherein the number N rows or columns of pixels to be selected simultaneously by said write pixel selecting means is equal to or smaller than half of a total number of the rows or columns in the matrix.

3. The image display device according to claim 1, wherein said write pixel selecting means passes said display signal current N times to each of the pixels in one frame period, and each of said selected pixels illuminates on the basis of a current value of said display signal current of the last time of the N times.

4. The image display device according to claim 3, wherein lighting of said pixels starts after completion of passage of said display signal current of N times per frame.

5. The image display device according to claim 4, wherein a timing to start and stop said lighting is the same for all of the pixels.

6. The image display device according to claim 1, wherein said light emitting device is an organic light emitting diode provided in said pixel.

7. The image display device according to claim 6, wherein said pixel further includes:

first switching means provided between one end of said organic light emitting diode and a first node;

second switching means provided between said first node and said signal line;

a drive TFT of said organic light emitting diode provided between said first node and a power source line;

third switching means provided between a gate and a drain of said drive TFT; and capacitance means provided between the gate and a source of said drive TFT.

8. The image display device according to claim 7, wherein one end of said organic light emitting diode is an anode electrode and a conduction type of said drive TFT is an n channel.

9. The image display device according to claim 7, wherein said first to third switch means is TFTs whose gate electrodes are commonly connected to each other, and the conduction type of the TFT of said first switching means and that of the TFTs of said second and third switching means are opposite to each other.

10. The image display device according to claim 1, wherein a drive circuit for driving said light emitting device is constructed by a polycrystalline Si-TFT.

11. The image display device according to claim 10, wherein polycrystalline silicon as the material of said polycrystalline Si-TFT is polycrystallized by being scanned with a laser beam having a major axis direction in a pulse form, and the major axis direction of said laser beam is almost parallel with an extending direction of said signal line.

12. An image display device comprising:

a pixel having a light emitting device which is driven to emit light on the basis of a display signal current;

a display unit constructed by a plurality of said pixels;

a signal line for passing the display signal current to said pixels;

write pixel selecting means for selecting a pixel to which said display signal current is to be passed via said signal line from said plurality of pixels; and display signal current generating means for generating said display signal current, wherein said light emitting device is an organic light emitting diode provided in said pixel, and said pixel further includes:

first switching means provided between an anode electrode of said organic light emitting diode and a first node;

second switching means provided between said first node and said signal line;

a drive TFT of an n-type channel of said organic light emitting diode provided between said first node and a power source line;

third switching means provided between a gate and a drain of said drive TFT; and capacitance means provided between the gate and a source of said drive TFT.

13. An image display device comprising:

a pixel having a light emitting device which is driven to emit light on the basis of a display signal current;

a display unit constructed by a plurality of said pixels arranged in a matrix;

a signal line for passing said display signal current to said pixels;

write pixel selecting means for selecting at least one row or column of said pixels to which said display signal current is to be passed via said signal line from said plurality of pixels;

storing means for storing data fetched from the outside; and display signal current generating means for generating said display signal current by performing an image data process on the basis of said stored data, wherein said write pixel selecting means further includes a function of simultaneously selecting N rows or columns of pixels, N being an integer equal to or greater than 2.

* * * * *